US006234401B1

(12) United States Patent
Lagö

(10) Patent No.: US 6,234,401 B1
(45) Date of Patent: May 22, 2001

(54) METHOD OF ASSEMBLING RAILS AND SLEEPERS AND TRACK FOR TRACKBOUND VEHICLES

(76) Inventor: Thomas Lagö , Snöbollsvägen 29, 564 34, Bankeryd (SE)

( * ) Notice: Subject to any disclaimer, the term of this patent is extended or adjusted under 35 U.S.C. 154(b) by 0 days.

(21) Appl. No.: 09/117,828

(22) PCT Filed: Feb. 13, 1997

(86) PCT No.: PCT/SE97/00220

§ 371 Date: Aug. 12, 1998

§ 102(e) Date: Aug. 12, 1998

(87) PCT Pub. No.: WO97/30226

PCT Pub. Date: Aug. 21, 1997

(30) Foreign Application Priority Data

Feb. 13, 1996 (SE) ..... 9600521

(51) Int. Cl.[7] ..... E01B 19/00
(52) U.S. Cl. ..... 238/382

(58) Field of Search ..... 238/382, 2, 283; 29/16, 592, 700, 709, 714, 720, 284

(56) References Cited

U.S. PATENT DOCUMENTS 3,974,963 * 8/1976 Noble et al. ..... 238/382
5,725,149 * 3/1998 Goossens ..... 238/382

FOREIGN PATENT DOCUMENTS 3832677 4/1989 (DE) .
3937086 5/1991 (DE) .
9321386 10/1993 (WO) .

* cited by examiner

*Primary Examiner*—Mark T. Le
(74) *Attorney, Agent, or Firm*—Birch, Stewart, Kolasch & Birch, LLP

(57) ABSTRACT

Method and track when assembling rails and sleepers, the assembly being carried out with different degrees of resilient softness between rail and sleeper. The degrees of resilient softness are selected on the basis of a PN sequence.

6 Claims, 2 Drawing Sheets

FIG I

METHOD OF ASSEMBLING RAILS AND SLEEPERS AND TRACK FOR TRACKBOUND VEHICLES

This application is the national phase under 35 U.S.C. §371 of prior PCT International Application No. PCT/SE97/00220 which has an International filing date of Feb. 13, 1997 which designated the United States of America, the entire contents of which are hereby incorporated by reference.

BACKGROUND OF THE INVENTION

1. Field of the Invention

The present invention relates to a method of assembling rails and sleepers, the assembly being carried out with different degrees of resilient softness. The invention also concerns a track for trackbound vehicles, where rails and sleepers are assembled with different degrees of resilient softness.

2. Description of Background Art

When a train moves along a railway track, large amounts of energy are released. Part of the released energy is spread as noise from the train, down into the ground, out in the air and into and along the track. This noise, of course, causes serious problems in built-up areas. Attempts are usually made to obviate these problems by means of embankments or other types of noise protection, which are costly.

Attempts have also been made to solve the problem of noise by assembling rails and sleepers with more or less resilient softness. The resilient softness is determined by the properties of the elastic rail seat which is positioned between the rail base and sleeper and which usually consists of two steel plates with a rubber portion therebetween. The resilience is determined by the quality of the rubber. Assembly with little resilient softness causes attenuation of the noise in the track, but not out in the air and down into the ground, whereas assembly with great resilient softness causes attenuation of the noise out in the air and down into the ground but hardly along the track, insofar as the noise effect directed along the rail is released in the first discontinuity in the rail, resulting in noise in this position. Finally, rails and sleepers have been assembled with alternatingly great and little resilient softness. In fact, this results in the energy released by the train being distributed in a somewhat more uniform manner to the surroundings, but this is also no satisfactory solution to the noise problem.

SUMMARY OF THE INVENTION

One object of the present invention is to improve the above-described prior art technique of assembly and select the resilient softness in the assembly such that a more efficient attenuation of noise is achieved. A further object is to provide a track with improved noise attenuation properties.

The objects are achieved by a method and an apparatus in accordance with the present invention.

The invention provides for a method of assembling rails and sleepers when laying a track for trackbound vehicles, the assembly being carried out with different degrees of resilient softness, wherein the degrees of resilient softness are selected on the basis of a PN sequence.

Further, the invention provides for a track for trackbound vehicles, rails and sleepers being assembled with different degrees of resilient softness, wherein the degrees of resilient softness are selected on the basis of a PN sequence.

The invention is based on the knowledge that a PN sequence spreads the frequency content of a signal, which is a well-known phenomenon in signal processing. A PN sequence, a pseudonoise sequence, is a random sequence which can be generated by means of a feedback filter, The length of the filter, i.e. the number of delay steps, determines the frequency properties of the generated sequence. The longer the filter the more the frequency content is spread, or smeared. According to the invention, the emitted effect of the train is spread in frequency by the sleepers being assembled with the rails with at least two different degrees of resilient softness according to a PN sequence. In addition to the achievement of a frequency spread, which results in a considerable decrease of the noise level, the possibility of distributing the emitted effect more uniformly is maintained. The inventive method means that first a PN sequence having at least two levels is generated by means of a suitable filter. The length of the filter is determined according to the desire of spreading the energy in frequency in the surroundings where the sleepers are to be located. Subsequently, each level of the PN sequence is allowed to represent its degree of resilient softness.

Then, by assembling rails and sleepers according to this representation, with different resilience, in the same relative order as the levels of the generated PN sequence, a smearing of the noise frequency content of the train is achieved. In a preferred embodiment, the PN sequence is given two levels, use being made of two different degrees of resilient softness when assembling the sleepers and the rails along the track. In another preferred embodiment, use is made of more than two different degrees of resilient softness in the assembly in order to further optimize the controlling of the effect. This embodiment means that first a PN sequence is generated, which has preferably two levels and which is allowed to pass through a digital optimization filter.

The digital optimization filter is designed according to certain optimization criteria, such as the desired number of different degrees of resilient softness and the desired frequency response of the specific case. What frequency response is desired depends on in what surroundings the sleepers are to be arranged. In areas of, for instance, clayey ground it is not suitable to let the effect be spread in low-frequency form, and therefore the optimization filter is in this case given a design which shifts the effect from low frequencies to high frequencies. After having generated a sequence with desired properties by means of the digital optimization filter, each level of this sequence is allowed to represent a degree of resilient softness, such that each of the different degrees of resilient softness is represented in the sequence in assembly. According to this representation, the sleepers and rails are then assembled with different resilience along the track in the same relative order as the levels of the generated sequence.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described in more detail with reference to the accompanying drawings, in which.

DESCRIPTION OF THE PREFERRED EMBODIMENTS

Figure 1:
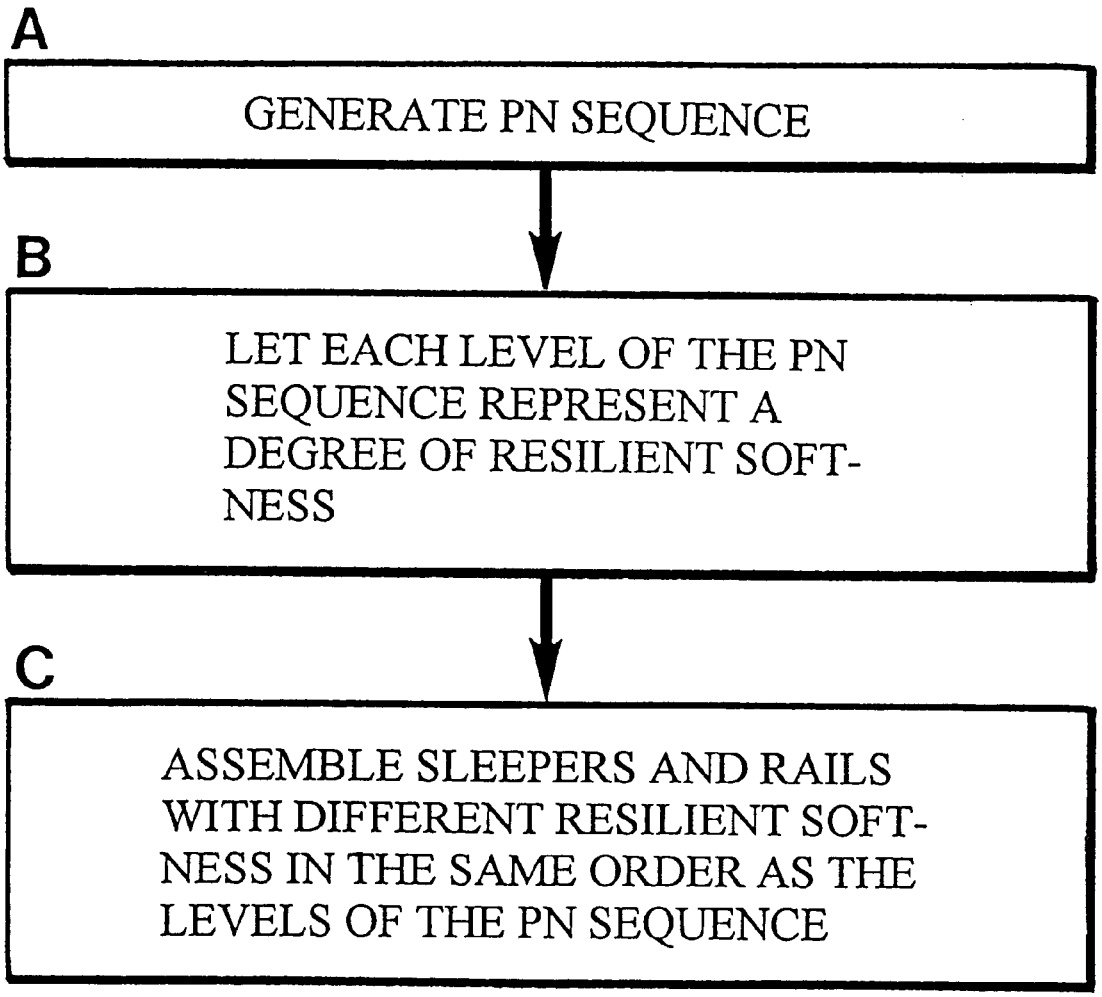
FIG. 1 is a flow diagram which describes the steps that are to be carried out when using an embodiment according to the present invention.
Figure 2:
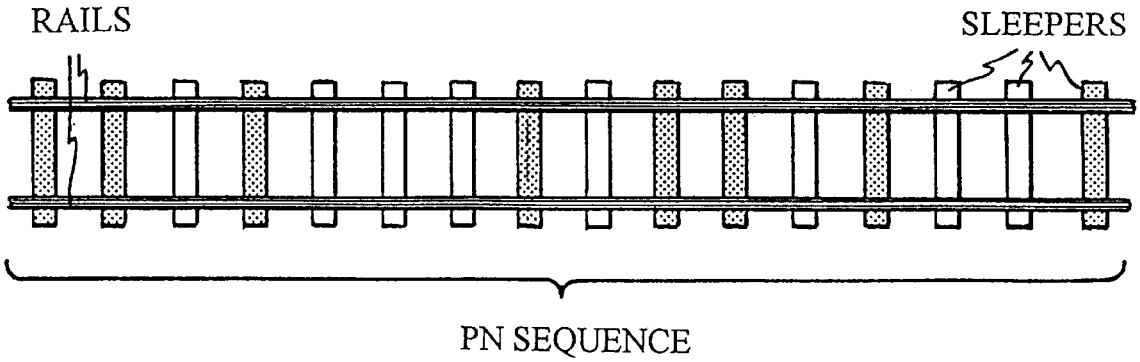
FIG. 2 shows an arrangement of sleepers and rails assembled with different resilient softness, which arrangement is the result when the embodiment in FIG. 1 is used.
Figure 3:
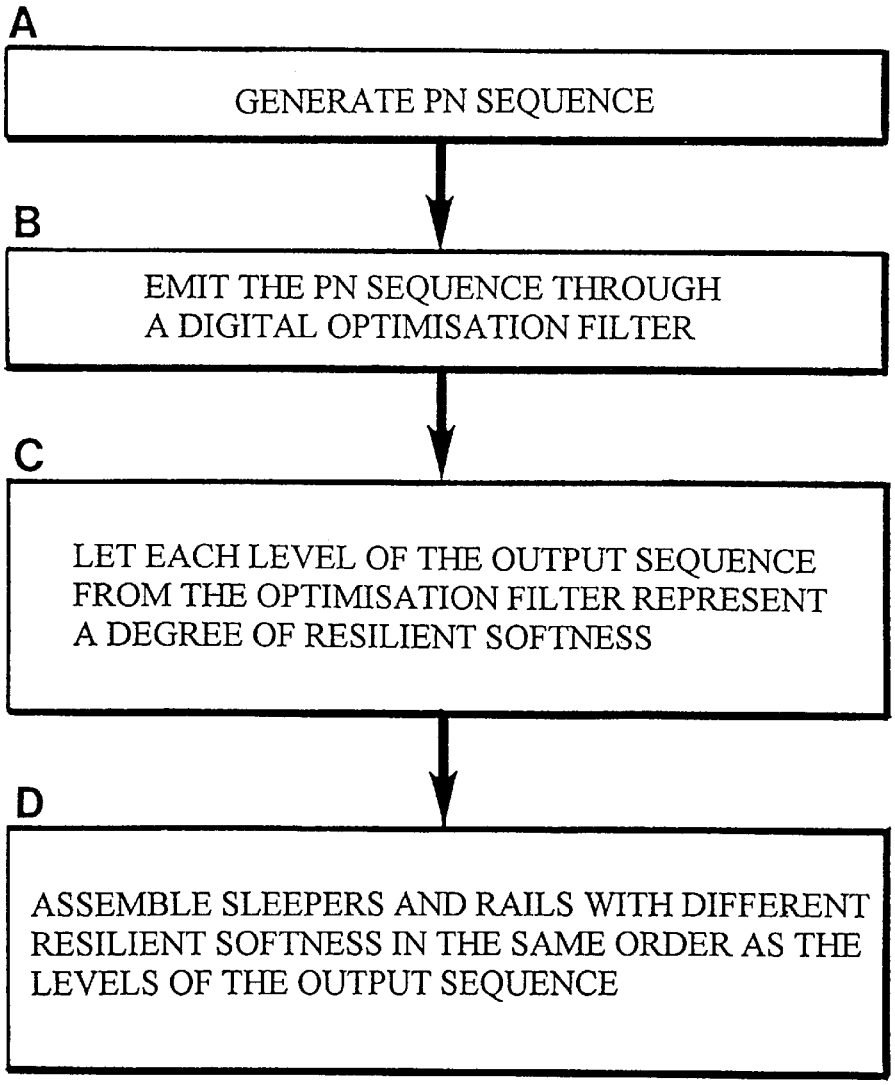
FIG. 3 is a flow diagram which describes the steps that are to be carried out when using a different embodiment according to the invention.

FIG. 1 shows the steps that are to be carried out in one embodiment according to the present invention. In this embodiment, use is made of two different degrees of resilient softness when assembling sleepers and rails along a track. In step A, a PN sequence of a suitable length and having two different levels is generated. Then in step B, each of the levels of the generated PN sequence is allowed to represent a degree of resilient softness. Finally, in step C the sleepers and rails are assembled with different resilient softness in the same relative order as the levels of the generated PN sequence, according to the representation in step B. FIG. 2 illustrates an example of an arrangement which may result when the embodiment according to the flow diagram in FIG. 1 is used. The dark sleepers are assembled with the rails having little resilience and the light sleepers are assembled with the rails having great resilience. FIG. 3 shows the steps that are to be carried out in another embodiment according to the present invention. In this embodiment, use is made of more than two different degrees of resilient softness when assembling sleepers and rails along a track. In step A, a PN sequence, or the like, of a suitable length is generated. Then in step B, the PN sequence is allowed to pass through a digital optimization filter, the properties of which are selected on the basis of given optimization criteria, such as the desired frequency response and the number of levels that is desirable in the output sequence of the optimization filter. The number of levels is preferably selected to be equal to the number of different degrees of resilient softness. In step C, each level of the output sequence from the optimization filter is allowed to represent a degree of resilient softness, such that each of the different degrees of resilient softness is represented in this output sequence in the assembly. Finally, in step D, the sleepers and rails having different resilient softness are assembled in the same relative order as the levels of the generated output sequence, according to the representation in step C.

Several modification of the invention are, of course, possible within the scope of the invention. For instance, the PN sequence can be replaced by other types of random sequences, such as a PBR sequence that is well-known from signal processing. Also maximum-length sequences can advantageously be used for the purposes of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of assembling rails and sleepers when laying a track for trackbound vehicles, comprising the steps of:

assembling said rails and sleepers with different degrees of resilient softness; and selecting the degrees of resilient softness on the basis of a PN sequence.

2. The method as claimed in claim 1, wherein said step of selecting further comprises:

selecting either of two different degrees of resilient softness based upon a PN sequence having two different levels, where the two levels of the PN sequence are each made to represent a respective one of said two different degrees of resilient softness; and wherein said step of assembling further comprises assembling the sleepers and rails along the track with degrees of resilient softness in a relative order conforming with the levels of the PN sequence.

3. The method as claimed in claim 1, wherein said step of selecting further comprises:

selecting more than two different degrees of resilient softness; and emitting the PN sequence through such a digital optimization filter as converts the PN sequence to a new sequence having a selected number of levels which is equal to the number of different degrees of selected resilient softness, where each level of the new sequence is selected to represent a degree of resilient softness, such that each of the different degrees of resilient softness is represented in the new sequence; and wherein said step of assembling further comprises assembling the sleepers and rails along the track with degrees of resilient softness in a relative order conforming with the levels of the new sequence.

4. A track for trackbound vehicles, comprising rails and sleepers assembled with different degrees of resilient softness, wherein the degrees of resilient softness are selected on the basis of a PN sequence.

5. The track as claimed in claim 4, wherein the sleepers and rails are assembled along the track with differently resilient assembly in a relative order conforming with a PN sequence having two levels, one level of the PN sequence representing a more resilient degree of assembly and the other level of the PN sequence representing a less resilient degree of assembly.

6. The track as claimed in claim 4, wherein the sleepers and rails are assembled along the track with different degrees of resilient assembly in a relative order conforming with a generated new sequence obtained by the PN sequence being emitted through a digital optimization filter and having a number of levels equal to the number of different degrees of resilient softness, each level of the new sequence representing a degree of resilient softness, such that each of the different degrees of resilient softness is represented in the new sequence.

* * * * *